US008525749B2

(12) United States Patent
Cho et al.

(10) Patent No.: US 8,525,749 B2
(45) Date of Patent: Sep. 3, 2013

(54) GROUND STRUCTURE OF ANTENNA OF MOBILE TERMINAL

(75) Inventors: Han Min Cho, Yongin-si (KR); Sang Moo Cha, Suwon-si (KR); Yong Tae Kim, Hwaseong-si (KR); Ung Ryeol Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 356 days.

(21) Appl. No.: 12/860,983

(22) Filed: Aug. 23, 2010

(65) Prior Publication Data

US 2011/0050533 A1 Mar. 3, 2011

(30) Foreign Application Priority Data

Aug. 28, 2009 (KR) ..... 10-2009-0080754

(51) Int. Cl.
*H01Q 1/48* (2006.01)

(52) U.S. Cl.
USPC ..... 343/848; 343/702; 343/846

(58) Field of Classification Search
None
See application file for complete search history.

(56) References Cited

U.S. PATENT DOCUMENTS

| | | | | |
|---|---|---|---|---|
| 7,012,571 | B1 * | 3/2006 | Ozkar et al. | 343/702 |
| 7,042,404 | B2 * | 5/2006 | Jo et al. | 343/702 |
| 8,228,240 | B2 * | 7/2012 | Kim et al. | 343/702 |
| 2007/0052596 | A1 * | 3/2007 | Liu et al. | 343/702 |

* cited by examiner

*Primary Examiner* — Anh Tran
(74) *Attorney, Agent, or Firm* — Jefferson IP Law, LLP

(57) ABSTRACT

An antenna ground structure of a mobile terminal is disclosed. The antenna ground structure of a mobile terminal is arranged to provide the ground pattern on a Printed Circuit Board (PCB) adjacent to the antenna and to electrically connect the ground pattern to the ground unit of the antenna, so that the area of the ground of the antenna may be expanded to improve Specific Absorption Rate (SAR) and communication performance.

11 Claims, 5 Drawing Sheets

GROUND STRUCTURE OF ANTENNA OF MOBILE TERMINAL

PRIORITY

This application claims the benefit under 35 U.S.C. §119 (a) of a Korean patent application filed on Aug. 28, 2009 in the Korean Intellectual Property Office and assigned Serial No. 10-2009-0080754, the entire disclosure of which is hereby incorporated by reference.

BACKGROUND OF THE INVENTION

1. Field of the Invention:

The present invention relates to a mobile terminal. More particularly, the present invention relates to a ground structure of an antenna of a mobile terminal having an optimized arrangement in a restricted space of the mobile terminal.

2. Description of the Related Art:

Mobile terminals provide various user functions such as a mobile communication function, a game function, a scheduling function, and other functions while maintaining mobility and are widely used by a great number of users.

However, the mobile terminal should be small in order to support mobility and must bear various designs for the satisfaction of user's various demands. Since recent mobile terminals should provide various functions, a great number of parts are arranged in the mobile terminal. Thus, the mobile terminal must be designed to maximize a restricted space therein.

More particularly, since an antenna should guarantee proper mobile communication performance, there is a limit of the degree to which the antenna may be reduced in size and still retain a proper ground structure. However, a mobile terminal of the related art does not make good use of space and has a limited degree to which communication performance can be guaranteed by increasing transmission power to satisfy a Specific Absorption Rate (SAR) that is set by an international standard. In the mobile terminal of the related art, in order to conform to SAR and to guarantee performance, antenna patterns are arranged far from the human body. However, it is difficult to design a relatively large antenna pattern within the restricted space of the mobile terminal of the related art.

SUMMARY OF THE INVENTION

An aspect of the present invention is to address at least the above-mentioned problems and/or disadvantages and to provide at least the advantages described below. Accordingly, an aspect of the present invention is to provide a ground structure of an antenna enabling communication performance of a mobile terminal.

In accordance with an aspect of the present invention, an antenna ground apparatus of a mobile terminal is provided. The apparatus includes an antenna, a printed circuit board disposed adjacent to the antenna, and a ground pattern formed on the printed circuit board and electrically connected to a ground unit of the antenna.

In accordance with another aspect of the present invention, a mobile terminal is provided. The terminal includes an antenna, a printed circuit board disposed adjacent to the antenna, a ground pattern formed on the printed circuit board and electrically connected to a ground unit of the antenna, and a case for encasing the antenna and the printed circuit board.

According to the ground structure of an antenna of a mobile terminal, an area of ground of the antenna is maximized within a restricted space of the mobile terminal so that communication performance may be improved and performance of the antenna may be optimized.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms or words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
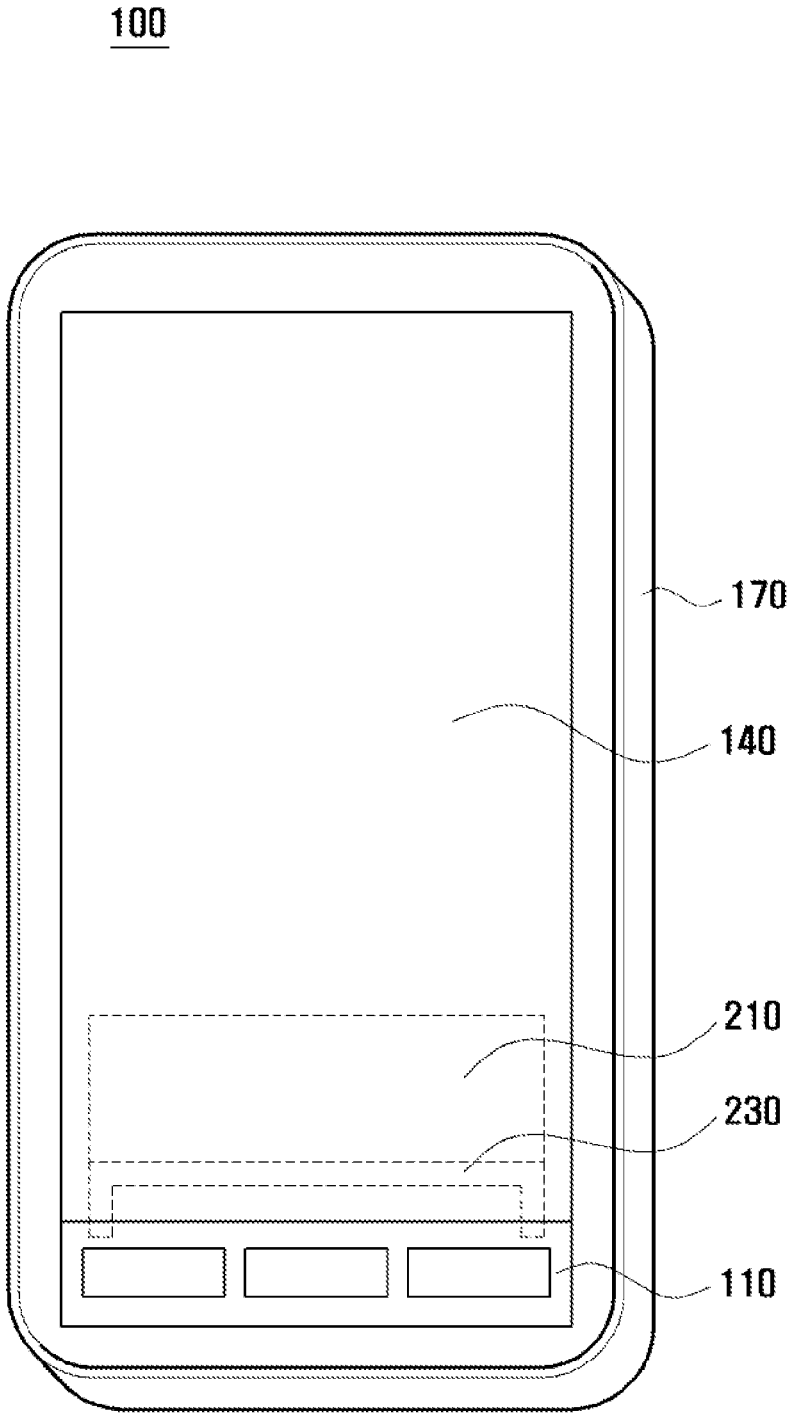
FIG. 1 is a schematic view illustrating an exterior of a mobile terminal according to an exemplary embodiment of the present invention.
Figure 2:
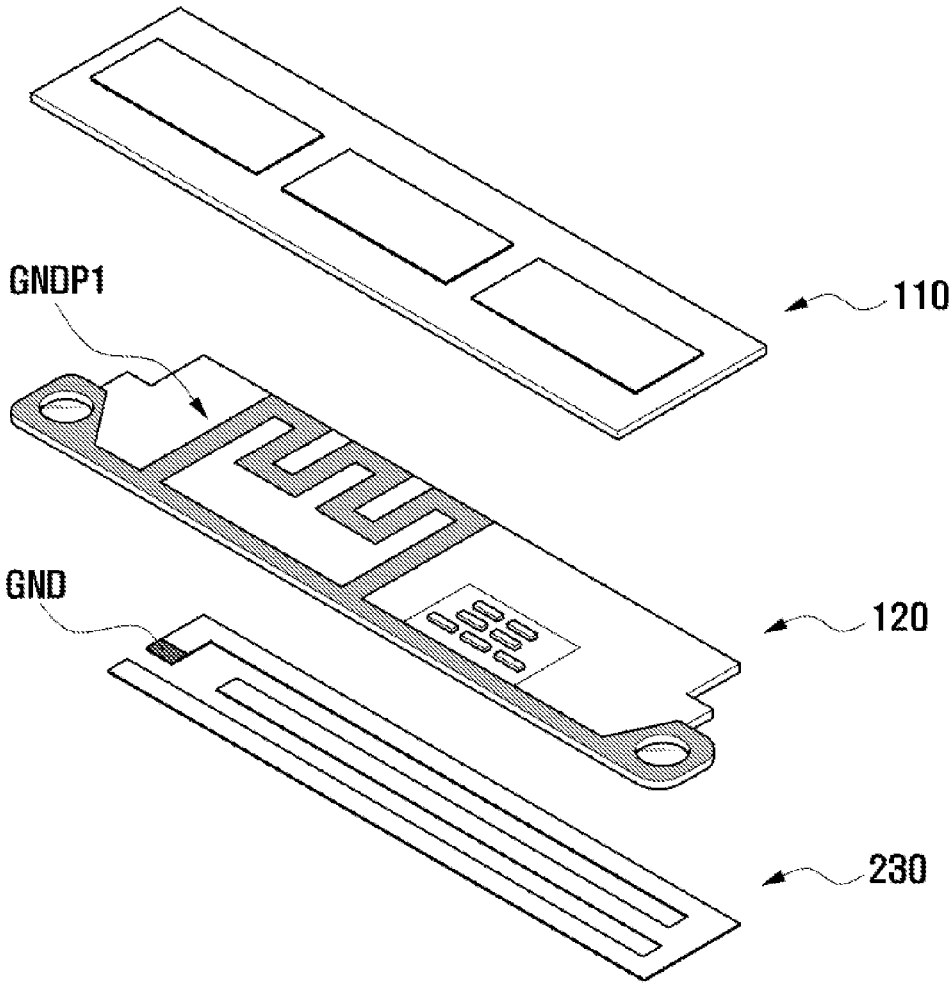
FIG. 2 is an exploded perspective view illustrating a keypad Printed Circuit Board (PCB) and other elements arranged near an antenna according to an exemplary embodiment of the present invention.
Figure 3:
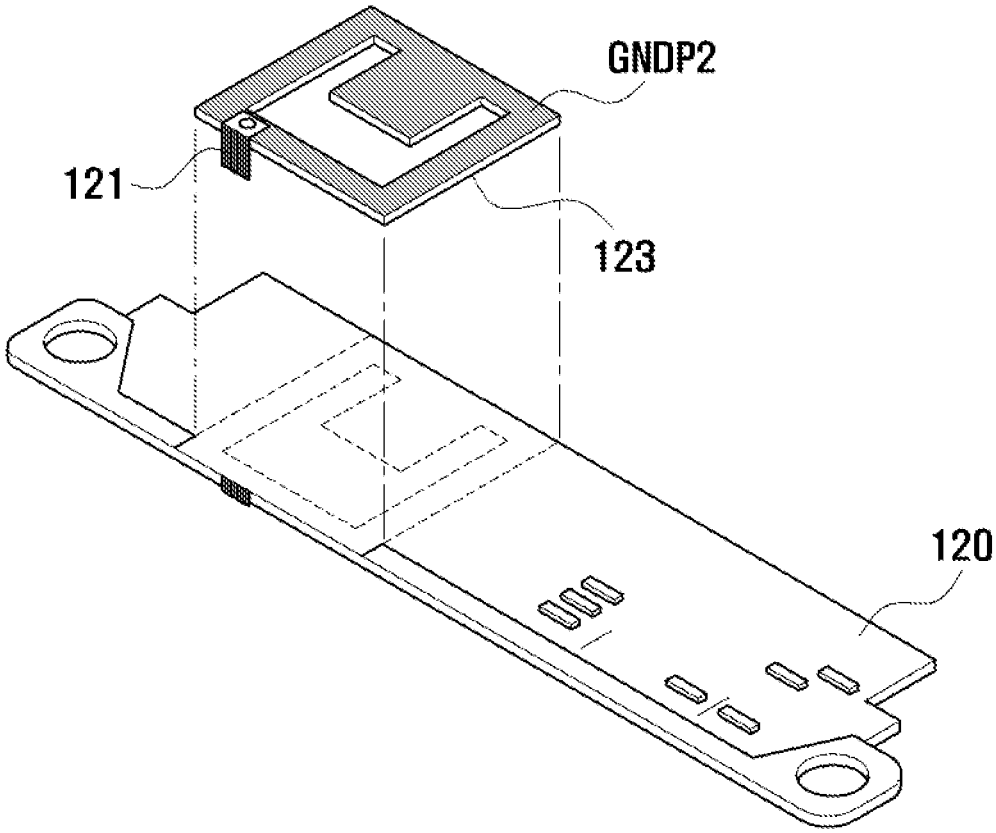
FIG. 3 is an exploded perspective view illustrating a keypad PCB of an antenna according to an exemplary embodiment of the present invention.

FIG. 1 is a schematic view illustrating an exterior of a mobile terminal according to an exemplary embodiment of the present invention. FIG. 2 is an exploded perspective view illustrating a keypad Printed Circuit Board (PCB) and other elements arranged near an antenna according to an exemplary embodiment of the present invention. FIG. 3 is an exploded perspective view illustrating a keypad PCB of an antenna according to an exemplary embodiment of the present invention. A mobile terminal 100, which is illustrated in FIGS. 1 to 3, includes a main PCB directly connected to an antenna. While a bar type mobile terminal may be illustrated in FIGS. 1-3 and described herein, the present invention is not limited to any particular type of mobile terminal.

Referring to FIGS. 1 to 3, the mobile terminal 100 may include an antenna 230 for transmission and reception of signals that are used for communication, a main PCB 210 for processing signals to be transmitted and received through the antenna 230, a display unit 140 for displaying a screen supporting a communication procedure and a user to use the mobile terminal, a keypad 110 for inputting a key actuation, a keypad PCB 120 positioned under the keypad 110 and having at least one of a first ground pattern GNDP1 and a second ground pattern GNDP2, and a case 170 for supporting the display unit 140 and the keypad 110 and for encasing the antenna 230, the main PCB 210, and the keypad PCB 120.

In the mobile terminal 100, the ground structure of the antenna 230 may be expanded when the antenna 230 is connected to at least one of the first ground pattern GNDP1 and the second ground pattern GNDP2 that are provided on the keypad PCB 120. The area of the ground of the antenna 230 may be increased by at least one of the first ground pattern GNDP1 and the second ground pattern GNDP2 so that performance and a Specific Absorption Rate (SAR) of the antenna 230 may be improved. Hereinafter, elements of the mobile terminal 100 will be described below in more detail.

The antenna 230 radiates a signal to be transmitted in the air and receives signals radiated in the air when the communication function is activated. The antenna 230 may be provided in the case 170. The antenna 230 may have a preset pattern so as to be disposed in the case 170. A least one of a length and a volume of the antenna 230 may vary according to the communication protocol supported by the mobile terminal 100. The antenna 230 may have at least one of a length and a volume supporting respective communication protocols when the mobile terminal 100 supports several communication protocols. For example, when the mobile terminal 100 supports one of Global System for Mobile communication (GSM) and Wideband Code Division Multiple Access (WCDMA), the antenna 230 has at least one of a length and a volume for supporting the respective one of GSM and WCDMA. The antenna 230 may be disposed at a lower side of the case 170 and may encase the edges of the display unit 140. In this case, the antenna 230 may be coupled with various locking steps or protrusions that are formed in the case 170 in order to prevent the antenna 230 from moving after the antenna 230 is disposed in the case 170. For example, when the antenna 230 has patterns, the antenna 230 may have holes formed in the respective patterns such that the respective patterns are coupled with protrusions provided in the case 170. A ground unit GND of the antenna 230 contacts at least one of the first ground pattern GNDP1 and the second ground pattern GNDP2 of the keypad PCB 120. The antenna 230 may further include a ground line to contact at least one of the first and second ground patterns GNDP1 and GNDP2 of the keypad PCB 120. For example, when the antenna 230 is spaced apart from the keypad PCB 120 by a distance, the antenna 230 may be positioned to face at least one of the first and second ground patterns GNDP1 and GNDP2 of the keypad PCB 120. In this case, the mobile terminal 100 may have a protrusion 121 serving as the ground line electrically connecting at least one of the first and second ground patterns GNDP1 and GNDP2 to the antenna 230. Referring to FIG. 3, the protrusion 121 may be formed in the second ground pattern GNDP2 or at a side of the antenna 230.

The main PCB 210 controls overall user functions provided by the mobile terminal 100. The main PCB 210 may control electric power fed from a power supply to respective units of the mobile terminal 100 to boot the mobile terminal 100. The main PCB 210 controls power to be fed to a communication module and signal transmission and reception to be performed through the antenna 230 when a user function, for example, a mobile communication function, is requested. Moreover, the main PCB 210 may control various modules such as a broadcasting receiver module, a Global Positioning System (GPS) module, and an MP3 or MP4 module and may control the various modules to be activated in response to a request for a specific function transmitted from the keypad 110. The main PCB 210 may store various routines for supporting and controlling the respective functions of the mobile terminal 100 and may load the routines to prepare activation of the loaded functions during the booting. The main PCB 210 may store various information generated when the user function is performed in a storage unit according to a user command. Moreover, the main PCB 210 may be electrically connected to the antenna 230, transmit signals for the mobile communication to the antenna 230, and process signals received by the antenna 230.

The display unit 140 outputs images during the activation of the various functions of the mobile terminal 100. For example, the display unit 140 may display an image between respective booting procedures during the booting of the mobile terminal 100 and may output an image related to activation of a specific user function according to a user command. That is, the display unit 140 may display various menus of the mobile terminal 100, information input by a user, information provided to the user, and may provide various screens such as a standby screen, a menu screen, a message writing screen, a dialing screen, etc. The display unit 140 may be a flat display such as a Liquid Crystal Display (LCD), an Organic Light Emitting Diode (OLED), and the like. When the flat display is a touch screen, the display unit 140 may be included in an input device. When the display unit 140 is realized by a touch screen, the display unit 140 may include a display panel and a touch sensor arranged on the display panel. The mobile terminal may provide various menu screens performed by the touch screen, that is, the display unit 140. Since edges of the display unit 140 are supported by the case 170, the display unit 140 may be prevented from moving and may prevent light leakage, which is light emitted from a backlight through sides of the display unit.

The case 170 encases the edges of the display unit 140 and the edges of the keypad 110 and includes a first case and a second case interposing the patterns of the antenna 230 and the keypad PCB 120. The case 170 may substantially encase the structures of the mobile terminal 100, have various structures preventing the respective structure from moving, and be designed in various architectural shapes for durability and/or aesthetics.

The keypad 110 is disposed in a region adjacent to the display unit 140 such that the edges of the keypad 110 are supported by the case 170. The keypad 110 may have various shapes, for example, a protrusion protruding upwardly from a plane parallel to the case 170 by a distance, or may contact a preset contact point provided in the keypad PCB 120 using a pressure generated by a user's touch. Then, the keypad PCB 120 may generate an input signal allocated to a corresponding contact point and transmit the generated signal to the main PCB 210. The keypad 110 may be made of silicon, metal alloys, etc. When the keypad 110 is made of a metal alloy, the keypad 110 may not protrude toward the case 170. In the mobile terminal 100 according to the exemplary embodiment of the present invention, the keypad 110 may be independent from the display unit 140 and the mobile terminal 100 may further include a keypad PCB 120 to convert a pressure generated from the keypad 110 into an electrical signal. The number and types of keys provided in the keypad 110 may vary according to a designer's intent. That is, the keypad 110 may be a numeric keypad, an alphabetic keypad, an arrow keypad, a hotkey keypad, etc.

The keypad PCB 120 may be disposed under the keypad 110 and have various contact points to contact a pressed portion when a specific point of the keypad 110 is pressed. The keypad PCB 120 may generate an electrical signal corresponding to the contact generated at the contact point and may transmit the generated electrical signal to the main PCB 210. The contact points and shape of the keypad PCB 120 may be modified according to the shape of the keypad 110. More particularly, the keypad PCB 120 has at least one of the first and second ground patterns GNDP1 and GNDP2 formed on a side thereof. The first and second ground patterns GNDP1 and GNDP2 contact the ground unit GND of the antenna 230 to expand the area of the ground of the antenna 230. To this end, the first and second ground patterns GNDP1 and GNDP2 may be made by coating a conductive material in a preset shape. The keypad PCB 120 may be made of a copper plate with a coated side. The first and second ground patterns GNDP1 and GNDP2 are formed on the coated portion of the copper plate such that generation and transmission of the electrical signal of the keypad PCB are not impaired. The keypad PCB 120 may further include a ground line electrically connected to at least one of the first and second ground patterns GNDP1 and GNDP2 for contact with the ground unit GND of the antenna 230. The ground line may be provided at a side of the keypad PCB 120 or at a side of the case 170. The ground line may be formed as a tape that connects at least one of the first and second ground patterns GNDP1 and GNDP2 to the ground unit GND. The first and second ground patterns GNDP1 and GNDP2 may be made by various processes of forming patterns on the keypad PCB 120. For example, the patterns on the keypad PCB 120 may be deposited by a surface mounting technology.

The second ground pattern GNDP2, as illustrated in FIG. 3, may be deposited on a separated ground pattern structure 123 such as a dummy PCB. The upper side on which the ground pattern structure 123 is placed may be coated with non-conductive material to prevent an electrical signal from being transmitted and the second ground pattern GNDP2 may be deposited on the ground pattern structure 123. The ground pattern structure 123 may further include a ground line to electrically connect the second ground pattern GNDP2 to the ground unit GND of the antenna 230 and/or the first ground pattern GNDP1. The ground line may be made in the form of a protrusion 121. The ground pattern structure 123 may be partially cut off in order to provide a high ground function to a restricted area. Adhesive may be coated between the ground pattern structure 123 and the keypad PCB 120 to prevent the ground pattern structure 123, which is disposed on the keypad PCB 120, from moving. Alternatively, the ground pattern structure 123 may be mounted on the keypad PCB 120 using the surface mounting technology and may be prevented from moving after disposition.

All of the first and second ground patterns GNDP1 and GNDP2 may be formed on the keypad PCB 120. In other words, when the first ground pattern GNDP1 is formed on the keypad PCB 120, the ground pattern structure 123 may be disposed on the first ground pattern GNDP1 and the second ground pattern GNDP2 may be formed on the ground pattern structure 123. In this case, the ground pattern structure 123 may further include a ground line to electrically connect the first ground pattern GNDP1 to the second ground pattern GNDP2.

As described above, in the mobile terminal 100 according to an exemplary embodiment of the present invention, the first ground pattern GNDP1 may be provided on the keypad PCB 120 or the second ground pattern GNDP2 may be provided on the ground pattern structure 123 so as to contact the ground unit GND of the antenna 230 so that the area of the ground unit GND of the antenna 230 may be expanded.

Figure 4:
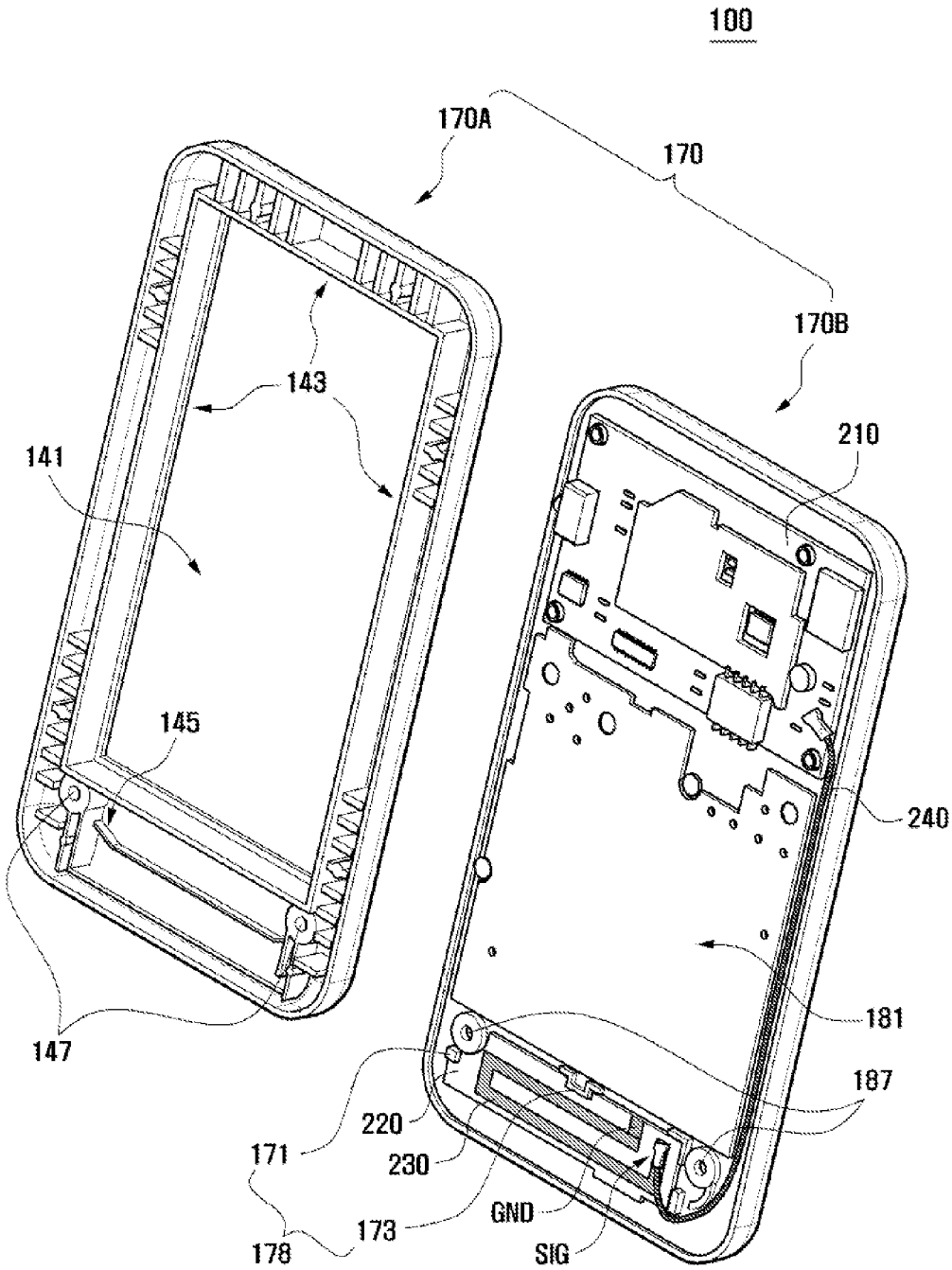
FIG. 4 is an exploded perspective view illustrating an interior of a mobile terminal according to an exemplary embodiment of the present invention.

FIG. 4 is an exploded perspective view illustrating an interior of a mobile terminal according to an exemplary embodiment of the present invention. The mobile terminal 100 may be a full screen mobile terminal without a separated keypad and may have a structure in which the main PCB 210 is spaced apart from the antenna 230 by a distance. Since the mobile terminal described below has similar elements as those of the mobile terminal described above, the same reference numerals are assigned to the same or similar elements.

Referring to FIG. 4, the case 170 of the mobile terminal 100 may have a first case 170A and a second case 170B. Various structures supporting the functions of the mobile terminal 100 may be arranged in the case 170. By doing so, the rims of the first and second cases 170A and 170B are coupled with each other to encase the various structures and to prevent the structures from moving.

The first case 170A, as illustrated, may include an opening 141 through which the display unit 140 is exposed and a first sub-PCB seat 145, on which a sub-PCB 220 to which patterns of the antenna 230 are attached, is seated. The first case 170A may support the opening 141 and may include sidewalls 143 covering edges of the display unit when the display unit is disposed inside the opening 141. The first case 170A may include a first screen coupling structure 147 formed in a region adjacent to the first sub-PCB seat 145 fastened to the second case 170B with a screw. A part of the first sub-PCB seat 145 facing the opening 141 may serve as one of the sidewalls 143 to cover the edge of the display unit. Each of the sidewalls 143 has an L-shaped section and structures of the sidewalls 143 facing the opening 141 contact the edges of the display unit. The sidewalls 143 may have auxiliary structures formed at a preset interval to support the sidewalls securely.

The first sub-PCB seat 145 is a structure on which the sub-PCB 220, to which the patterns of the antenna 230 are attached, is seated and may be formed to correspond to the shape of the sub-PCB 220. The first sub-PCB seat 145 may be formed similar to the outer appearance of the sub-PCB 220 to prevent the sub-PCB 220 from moving after the sub-PCB 220 is seated or such that the sub-PCB 220 is press-fitted into the first sub-PCB seat 145. Alternatively, the first sub-PCB seat 145 may have a locking structure, such as a step or protrusion, to lock the sub-PCB 220 at a specific position in order to prevent the sub-PCB 220 from moving or being separated after the sub-PCB 220 is seated. The locking structure is coupled with a corresponding structure, such as a protrusion or a hole, formed in the sub-PCB 220 to prevent the sub-PCB 220 from moving.

The second case 170B may have an opening (not shown) in which a battery is seated and L-shaped sidewalls in which various structures are seated. Various structures may be seated in the second case 170B, for example, the main PCB 210 may be seated in an upper portion thereof and the sub-PCB 220 may be seated in the lower portion thereof. A space defined by the main PCB 210 and the sub-PCB 220 may serve as a battery seat 181 on which the battery is seated. Although not illustrated, other structures such as a camera module, a broadcasting receiver module, an MP3 or MP4 module, etc. may be seated on the lower end of the main PCB 210. The second case 170B may further include a second sub-PCB seat 178 formed in the lower end of the second case 170B on which the sub-PCB 220 is seated. Thus, a PCB surface of the sub-PCB 220, to which the antenna 230 is attached, is seated on the first sub-PCB seat 145 and the opposite surface to which the antenna 230 is not attached, that is, the surface in which the ground pattern GNDP is formed is seated on the second sub-PCB seat 178. The second sub-PCB seat 178 formed in the lower end of the second case 170B, in order to fix the sub-PCB 220, may include various structures such as a protrusion 171 coupled with the hole formed in the sub-PCB 220 and a locking step 173 fixing a side of the sub-PCB 220. In addition, the second sub-PCB seat 178 may further include sidewalls covering and guiding the sides of the sub-PCB 220 in the coupling of the sub-PCB 220. The second case 170B may have a second screw coupling structure 187 formed in a side of the second case 170B, corresponding to the first screw coupling structure 147 formed in the first case 170A. A cable 240 connecting a signaling unit SIG of the antenna 230 that is attached to a side of the sub-PCB 220 to the contact point formed in a side of the main PCB 210 may be disposed along one of the sidewalls of the second case 170B.

The sub-PCB 220, on which the ground pattern GNDP is disposed, will be described in further detail below with reference to FIGS. 5 and 6.

Figure 5:
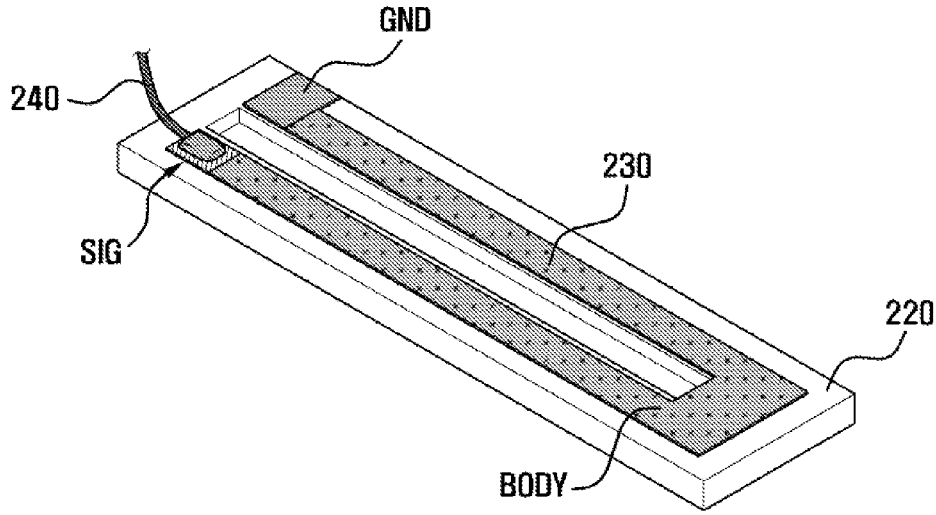
FIG. 5 is a perspective view illustrating a front side of a sub-PCB to which an antenna is attached according to an exemplary embodiment of the present invention.

FIG. 5 is a perspective view illustrating a front side of a sub-PCB to which an antenna is attached according to an exemplary embodiment of the present invention. FIG. 6 is a perspective view illustrating a back side of a sub-PCB on which a ground pattern is formed according to an exemplary embodiment of the present invention.

Figure 6:
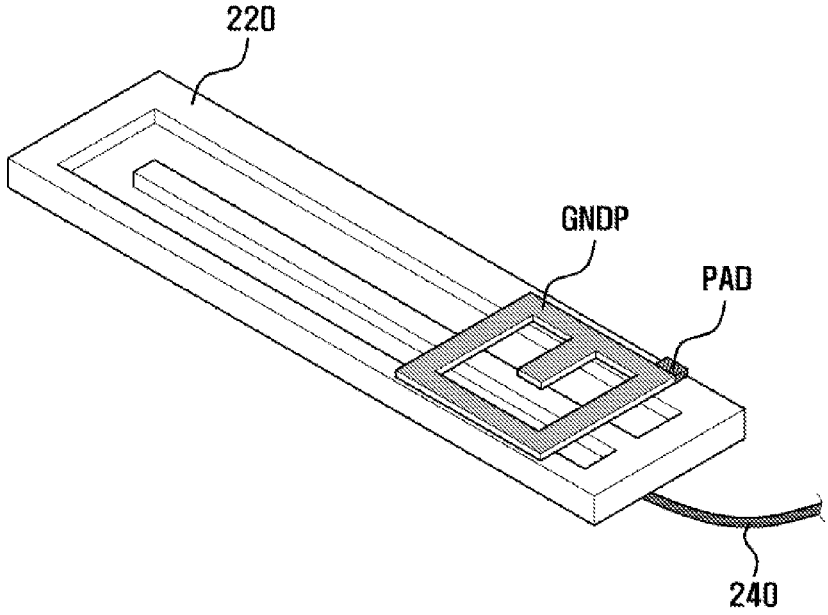
FIG. 6 is a perspective view illustrating a rear side of a sub-PCB on which a ground pattern is formed according to an exemplary embodiment of the present invention.

Referring to FIGS. 5 and 6, the pattern of the antenna 230 is attached to the entire front side of the sub-PCB 220. The sub-PCB 220 may be made of a plastic injection molding and may have a shape corresponding to a pre-designed pattern of the antenna 230. For example, when the pattern of the antenna 230 is stepped to form the preset pattern, the sub-PCB 220 may have a step corresponding to the stepped pattern of the antenna 230. In order to prevent the pattern of the antenna 230 from moving after the pattern is attached to the sub-PCB 220, various structures may be provided or adhesive may be coated between the pattern of the antenna 230 and the sub-PCB 220. For example, the sub-PCB 220 may have a plurality of protrusions and locking steps formed in a side of the sub-PCB 220 and the pattern of the antenna 230 may have through-holes coupled with the protrusions of the sub-PCB 220.

The antenna 230, as described above, may be modified in size, shape, area, and volume according to the communication protocol supported by the mobile terminal 100. The antenna 230 includes a signaling unit SIG, a ground unit GND, and a body BODY provided between the signaling unit SIG and the ground unit GND for the transmission of the signal transmitted from the main PCB 210 in the air and reception of signals transmitted in the air. The signaling unit SIG is a region contacting the signal line of the main PCB 210, for example, the cable 240. When the mobile terminal 100 supports a dual communication mode and the antenna 230 is designed to support the dual communication mode, the antenna 230 may have at least two signaling units SIG. The ground unit GND is a region providing a ground function of the antenna 230 and may be electrically connected to the ground pattern GNDP formed on the rear side of the sub-PCB 220. The ground pattern GNDP may be provided on the rear side of the sub-PCB 220 and may be electrically connected to the ground unit GND formed on the front side thereof. When the front side of the sub-PCB 220 has a step, the rear side thereof may have a recess corresponding to the step. That is, when a part of the front side of the sub-PCB 220 protrudes by a preset height, the rear side of the sub-PCB 220 may be depressed to correspond to the protrusion. The protrusion and the depression may be modified by a designer of the sub-PCB 220. Meanwhile, the ground pattern GNDP may be formed in a preset region of the rear side of the sub-PCB 220 in a preset shape. In this case, the ground pattern GNDP may be designed to be proportional to the volume of the antenna 230 and may be patterned to provide an optimal ground function within a part of the entire area of the sub-PCB 220. The ground pattern GNDP may be made by mounting a material to provide the ground function such as metal on the rear side of the sub-PCB 220 in the surface mounting technology or by bonding a preset pattern to the rear side with adhesive. The ground pattern GNDP may have a signal pad PAD formed on a side of the ground pattern GNDP and be electrically connected to the ground unit GND on the front side of the sub-PCB 220. The signal pad PAD electrically connects the ground pattern GNDP to the ground unit GND of the antenna 230 and to this end may be formed when the sub-PCB 220 is constructed or may be formed of a metal tape.

As described above, in the ground structure of an antenna of the mobile terminal according to an exemplary embodiment of the present invention, the ground pattern GNDP is provided on a side of the sub-PCB 220 on which the antenna 230 is disposed and the ground pattern GNDP is connected to the ground unit GND of the antenna 230 so that the area of the ground may be expanded by as much as the area of the ground pattern GNDP. Thus, the mobile terminal of an exemplary embodiment of the present invention may provide a stable ground function by expanding the ground area so that SAR and the communication performance may be improved.

At least one of the approach of providing the first ground pattern GNDP1 on the keypad PCB 120 according to the exemplary embodiment of the present invention, the approach of providing the ground pattern structure 123 on the keypad PCB 120 corresponding to the dummy PCB and of providing the second ground pattern GNDP2 on the ground pattern structure 123, and the approach of providing the ground pattern GNDP on the sub-PCB 220 according to another exemplary embodiment of the present invention, may be applied to the mobile terminal 100. That is, in the mobile terminal 100, the first ground pattern GNDP1 may be provided on the keypad PCB 120 and the ground pattern structure 123 on which the second ground pattern GNDP2 is mounted on the dummy PCB may be electrically connected to the first ground pattern GNDP1 of the keypad PCB 120. Otherwise, the keypad PCB 120 on which the first ground pattern GNDP1, the ground pattern structure 123, and the second ground pattern GNDP2 are formed and the ground pattern GNDP formed on the sub-PCB 220 may be applied to the mobile terminal 100 when the mobile terminal 100 is manufactured. The first and second ground patterns GNDP1 and GNDP2 and the ground pattern GNDP may have various shapes and the shapes may be modified according to the shape of a PCB disposed adjacent to the region in which the antenna is disposed and which may be changed according to the communication protocol or a model of the mobile terminal. In the following tables, results of performance tests are shown.

The term "TIS" denotes Total Isotropic Sensitivity. The term "TRP" denotes Total Radiated Power.

Table 1 shows results of a performance test carried out when the ground pattern is not applied to a specific model of a mobile terminal.

TABLE 1

| WCDMA band (CH) | TIS | TRP | SAR |
|---|---|---|---|
| 9,714 | 106.8 | 19.91 | 1.63 |
| 9,787 | 106.3 | 20.48 | 2.32 |
| 9,886 | 106.9 | 19.90 | 2.11 |

Table 2 shows results of a performance test carried out when the first ground pattern GNDP1 is formed on the keypad PCB 120 in a specific model of a mobile terminal.

TABLE 2

| WCDMA band (CH) | TIS | TRP | SAR |
|---|---|---|---|
| 9,714 | 106.8 | 20.01 | 1.33 |
| 9,787 | 106.7 | 21.02 | 1.82 |
| 9,886 | 106.8 | 20.70 | 1.71 |

Table 3 shows results of a performance test carried out when the first ground pattern GNDP1 formed on the keypad PCB 120 and the second ground pattern GNDP2 formed on the ground pattern structure 123 are applied to a specific model of a mobile terminal.

TABLE 3

| WCDMA band (CH) | TIS | TRP | SAR |
|---|---|---|---|
| 9,714 | 107.3 | 20.11 | 1.23 |
| 9,787 | 106.8 | 21.08 | 1.52 |
| 9,886 | 107.1 | 20.87 | 1.43 |

Table 4 shows results of a performance test carried out when the first and second ground patterns GNDP1 and GNDP2 are formed on the keypad PCB 120 and when the ground pattern GNDP is formed on the sub-PCB 220 in a specific model of a mobile terminal.

TABLE 4

| WCDMA band (CH) | TIS | TRP | SAR |
|---|---|---|---|
| 9,714 | 107.1 | 20.05 | 1.13 |
| 9,787 | 106.8 | 21.28 | 1.30 |
| 9,886 | 107.1 | 21.03 | 1.23 |

As shown in Tables 1 to 4, it is understood that satisfactory SAR and TIS/TRP are obtained as the ground pattern is increased.

As described above, the antenna ground structure of a mobile terminal according to an exemplary embodiment of the present invention is arranged to provide the ground pattern on a PCB adjacent to the antenna 230 and to connect the ground pattern to the ground unit GND of the antenna 230, so that the ground area of the antenna 230 may be expanded to improve SAR and the communication performance.

While the invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. An antenna ground apparatus of a mobile terminal, the apparatus comprising:

an antenna;

a printed circuit board disposed adjacent to the antenna; and a ground pattern formed on the printed circuit board and electrically connected to a ground unit of the antenna, wherein the printed circuit board comprises at least one of:

a keypad printed circuit board corresponding to the keypad for generating a key input signal of the mobile terminal; and a sub-printed circuit board on which the antenna is mounted, and wherein the ground pattern is formed on a side of the keypad printed circuit board.

2. An antenna ground apparatus of a mobile terminal, the apparatus comprising:

an antenna;

a printed circuit board disposed adjacent to the antenna;

a ground pattern formed on the printed circuit board and electrically connected to a ground unit of the antenna; and a dummy printed circuit board mounted on the keypad printed circuit board, wherein the printed circuit board comprises at least one of:

a keypad printed circuit board corresponding to the keypad for generating a key input signal of the mobile terminal; and a sub-printed circuit board on which the antenna is mounted.

3. The apparatus of claim 2, wherein the ground pattern is formed on the dummy printed circuit board.

4. The apparatus of claim 2, wherein the ground pattern is formed on a side of the keypad printed circuit board and on the dummy printed circuit board.

5. The apparatus of claim 1, wherein the ground pattern is formed on a side opposite to the side of the sub-printed circuit board on which the antenna is mounted.

6. The apparatus of claim 2, wherein the ground pattern is formed on a side of the keypad printed circuit board, a side of the dummy printed circuit board, and a rear side of the sub-printed circuit board, respectively.

7. The apparatus of claim 1, further comprising a ground line electrically connecting the ground pattern to the ground unit of the antenna.

8. The apparatus of claim 1, wherein the ground pattern is formed on the printed circuit board using a surface mounting technology.

9. The apparatus of claim 2, wherein the ground pattern is formed on a side opposite to the side of the sub-printed circuit board on which the antenna is mounted.

10. The apparatus of claim 2, further comprising a ground line electrically connecting the ground pattern to the ground unit of the antenna.

11. The apparatus of claim 2, wherein the ground pattern is formed on the printed circuit board using a surface mounting technology.

* * * * *